US008499666B2

(12) United States Patent
Hopper et al.

(10) Patent No.: US 8,499,666 B2
(45) Date of Patent: Aug. 6, 2013

(54) DUAL PAWL RATCHET MECHANISM AND REVERSING METHOD

(75) Inventors: Richard Hopper, Kenosha, WI (US); Michael Foster, Kenosha, WI (US); Christopher Thompson, Franklin, WI (US)

(73) Assignee: Snap-on Incorporated, Kenosha, WI (US)

( * ) Notice: Subject to any disclaimer, the term of this patent is extended or adjusted under 35 U.S.C. 154(b) by 1348 days.

(21) Appl. No.: 11/726,262

(22) Filed: Mar. 21, 2007

(65) Prior Publication Data

US 2008/0229889 A1 Sep. 25, 2008

(51) Int. Cl.
*B25B 13/46* (2006.01)

(52) U.S. Cl.
USPC ..... 81/63.1; 81/63.2

(58) Field of Classification Search
USPC ..... 81/58.1, 59.1–63.2
See application file for complete search history.

(56) References Cited

U.S. PATENT DOCUMENTS

| | | | |
|---|---|---|---|
| 581,427 | A | 4/1897 | Olson |
| 1,101,381 | A | 6/1914 | Anderson et al. |
| 2,201,827 | A | 5/1940 | Froeschl et al. |
| 2,981,389 | A | 4/1961 | Kilness |
| 2,982,161 | A | 5/1961 | Angquist et al. |
| 3,436,992 | A | 4/1969 | Over et al. |
| 4,520,697 | A | 6/1985 | Moetteli |
| 4,934,220 | A | 6/1990 | Slusar et al. |
| 5,884,537 | A | 3/1999 | Chen |
| 5,927,158 | A | 7/1999 | Lin |
| 6,125,722 | A | 10/2000 | Hopper, Jr. et al. |
| 6,357,323 | B2 | 3/2002 | Chi et al. |
| 6,584,875 | B1 | 7/2003 | Deng |
| 6,666,112 | B2 | 12/2003 | Hu |
| 6,691,594 | B2 | 2/2004 | Chen |
| 6,857,339 | B2 | 2/2005 | Chen |
| 6,971,285 | B2 | 12/2005 | Chen |
| 6,981,434 | B2 | 1/2006 | Chen |
| 6,997,084 | B1 | 2/2006 | Gao et al. |
| 7,044,029 | B1 | 5/2006 | Hopper |
| 7,073,412 | B1 | 7/2006 | Arnold |
| 7,080,579 | B2 | 7/2006 | Chen |

(Continued)

FOREIGN PATENT DOCUMENTS

| | | |
|---|---|---|
| DE | 20200060 | 11/2006 |
| GB | 2356168 | 5/2001 |

OTHER PUBLICATIONS

Chinese Notification of First Office Action re App. No. 2011092100618470 of Applicant, Snap-on Incorporated.

*Primary Examiner* — Robert Scruggs
(74) *Attorney, Agent, or Firm* — Seyfarth Shaw LLP

(57) ABSTRACT

A dual-pawl ratchet wrench mechanism is disclosed having a stop mechanism for limiting over-travel of a reversing lever for selecting drive directions. In one form, the wrench mechanism includes a ball and spring assembly that cooperate with recesses to define proper positions for the reversing lever, and one or more ramps are provided between the recesses to promote tactile feel and to promote the reversing lever being rotated to a proper position. In some forms, the stop mechanism is formed on a stationary portion, such as a spacer or the wrench body, and a portion of the reversing lever. The design simplifies manufacturing, such as by simplifying assembly and minimizing the need for securements. Additionally, the reversing lever is assembled with the mechanism in a manner to improve sealing.

21 Claims, 5 Drawing Sheets

U.S. PATENT DOCUMENTS

| | | | | |
|---|---|---|---|---|
| 7,082,859 | B2 | 8/2006 | Huang | |
| 7,082,860 | B2 | 8/2006 | Shu-Sui et al. | |
| 7,089,830 | B2 | 8/2006 | Hu | |
| 7,121,169 | B1 * | 10/2006 | Larson | 81/63 |
| 7,124,664 | B1 | 10/2006 | Lee | |
| 7,299,720 | B1 | 11/2007 | Schultz et al. | |
| 2002/0194965 | A1 | 12/2002 | Chen | |
| 2004/0003684 | A1 | 1/2004 | Chen | |
| 2004/0083858 | A1 | 5/2004 | Carnesi | |
| 2004/0089109 | A1 | 5/2004 | Chen | |
| 2004/0154439 | A1 | 8/2004 | Tuan-Mu | |
| 2004/0261584 | A1 | 12/2004 | Huang | |
| 2005/0011315 | A1 | 1/2005 | Chen | |
| 2005/0016332 | A1 | 1/2005 | Hu | |
| 2005/0193870 | A1 | 9/2005 | Chen | |
| 2005/0204868 | A1 | 9/2005 | Liu | |
| 2006/0016658 | A1 | 1/2006 | Gauthier | |
| 2006/0048610 | A1 | 3/2006 | Hu | |
| 2006/0065080 | A1 | 3/2006 | Davidson et al. | |
| 2006/0090608 | A1 | 5/2006 | Tsai | |
| 2006/0101952 | A1 | 5/2006 | Lee | |
| 2008/0229889 | A1 | 9/2008 | Hopper et al. | |

* cited by examiner

DUAL PAWL RATCHET MECHANISM AND REVERSING METHOD

CROSS-REFERENCE TO RELATED APPLICATION

The present application is related to U.S. patent application Ser. No. 11/726,263, filed concurrently with the present application and titled "Dual Pawl Ratchet Mechanism and Reversing Method."

FIELD OF THE INVENTION

The invention relates to dual pawl ratchet mechanisms and, in particular, to an improved reversible dual pawl device and method.

BACKGROUND

Currently many dual pawl ratchet mechanisms are known and used. Typically, these mechanisms are incorporated into handtools, such as wrenches and/or screwdrivers, or the like, so that there is a drive portion engageable with, for example, a bolt head. A first drive direction may be selected for the dual pawl ratchet mechanism so that use of the handtool provides torque when engaged with the bolt head and rotated in a first direction while slipping or ratcheting when rotated in a second direction. A second drive direction may be selected for the dual pawl ratchet mechanism that is opposite the first drive direction, and that provides torque and slip in the opposite directions.

In operating the reversible dual pawl mechanism, there is typically a manually actuable portion, commonly referred to as a reversing lever, that effects the engagement of one pawl and the disengagement of a second pawl, the actuable portion being commonly referred to as a reversing lever. The drive direction for the drive portion is dependent on which of the two pawls is engaged.

The reversing lever is typically rotated about an axis that is generally perpendicular to a face or side of the ratchet head to engage and dis-engage the pawls and, thus, to select the drive direction. The axis of rotation for the reversing lever is generally parallel to the axis of rotation of drive portion that provides the torque.

One of the problems with these handtools is the amount of rotation of the reversing lever. It is not uncommon to provide a spring and ball assembly, the spring biasing the ball into a detent, for defining the positions for the reversing lever. If the ball and detent cooperation is significant (such as due to a deep detent and spring with a high spring constant), the detent and ball can become worn or damaged. On the other hand, if the cooperation is slight, the mechanism may not provide a clear tactile indication of reaching a selected position and/or may permit accidental shifting from the selected position, again leading to damage.

When the ball is partially positioned over or within the detent, the spring can act to promote the ball being properly received in the detent. That is, the pressure of the ball against an edge of the detent serves to direct the reversing lever towards or to one of the proper, predetermined positions. However, due to the small size of the components, the ball must be nearly in the proper position for this to have any effect. More broadly, if the ball is not positioned nearly in the proper position, the spring pressure has no effect.

One of the important aspects of these types of tools is manufacturing complexity and costs. In using these ball/detent features, the manufacturing complexity and costs are increased. As an example of this, the spring is first inserted into a blind hole formed either in the tool head or in the reversing mechanism, and then the ball is positioned on the end of the spring prior to assembly with the other components. In high speed manufacturing operations, ensuring the ball remains in the proper place as the spring is compressed to allow the other components to be assembled is no small endeavor.

In another aspect of manufacturing costs and complexity, internal components are often utilized that allow one or more other components to be properly located. If these internal components are to be fixed in a specific position, it is common to have to provide a mechanical attachment such as screws.

Accordingly, there has been a need for an improved dual pawl mechanism and reversing method.

SUMMARY

In accordance with an aspect, a reversible ratchet device such as for a reversible wrench is disclosed including a ratchet body having a cavity therein, the ratchet body having a first side with a first body opening communicating with the cavity, a ratchet assembly received by the cavity through the first body opening, the ratchet assembly including a ratchet gear having a drive portion engageable for transmitting torque from operation of the device, the ratchet assembly also including a pawl mechanism having at least one pawl selectively engageable with the ratchet gear for a selected drive direction, a cover plate attachable to the first side for closing the cavity, a spring, a ball biased by the spring, and a reversing lever operably coupled with the pawl mechanism for selecting the drive direction, the reversing lever having a first recess for receiving the spring-biased ball in a first lever position corresponding to a first drive direction, and having a second recess for receiving the spring-biased ball in a second lever position corresponding to a second drive direction, and the reversing lever having a raised portion between the first and second recesses, the raised portion including a peak and first and second ramps leading from the peak to the first and second recesses respectively.

The first and second ramps may be generally linear.

The reversible ratchet device may further include a portion stationary relative to the ratchet body, the bore being formed in the stationary portion, the spring being received within the bore, the ball being partially received within the bore and partially extending from the bore when the reversing lever is in the first or second lever positions. The reversing lever may further include first and second stops formed thereon, the first and second recesses disposed between the first and second stops. The first stop may be disposed proximate the first recess, the second stop may be disposed proximate the second recess, rotation of the reversing lever between and to the first and second lever positions forces the ball towards the bore to compress the spring therein, and rotation beyond the first and second lever positions brings the reversing lever stops into contact with the stationary structure, the stationary structure thus restricting appreciable rotation of the reversing lever beyond the first and second lever positions.

The stationary structure may be a spacer disposed between the reversing lever and the cover plate. The spacer may be received by the cavity through the first body opening, the cavity and spacer having complementary structure for defining the position of the spacer within the cavity, and the assembled cover plate preventing appreciable movement of the spacer from the cavity. The bore is may be a throughbore having a first bore opening assembled proximate the reversing lever and a second bore opening assembled proximate the cover plate, the ball being inserted into the throughbore through the second bore opening to be proximate the reversing lever at the first bore opening, and the spring being inserted into the throughbore through the second bore opening to be proximate the cover plate at the second bore opening.

In another aspect, a reversible ratchet device such as for a reversible wrench is disclosed including a ratchet body having a cavity therein, the ratchet body having a first side with a first body opening communicating with the cavity, a ratchet assembly received by the cavity through the first body opening, the ratchet assembly including a ratchet gear having a drive portion engageable for transmitting torque from operation of the device, the ratchet assembly also including a pawl mechanism having at least one pawl selectively engageable with the ratchet gear for a selected drive direction, a cover plate attachable to the first side for closing the cavity, a reversing lever operably coupled with the pawl mechanism for selecting the drive direction, the reversing lever having first and second recesses and being movable between and to first and second lever positions corresponding to respective first and second drive directions, a spring, a ball biased by the spring into the reversing lever first recess in the first drive direction and biased by the spring into the reversing lever second recess in the second drive direction, and a throughbore having a first bore opening proximate to the reversing lever and a second bore opening distal to the reversing lever, the ball being inserted through the second bore opening to be disposed in biased contact with the reversing lever at the first bore opening, and the spring being inserted into the second bore opening after the ball is inserted therein.

The cover plate may be assembled proximate the second bore opening, and the spring may be compressibly disposed between the cover plate at the second bore opening and the ball. The reversible ratchet device may further include a spacer having the throughbore formed therein for receiving the ball and the spring. The spacer and the cavity may have complementary structure for defining the position of the spacer within the cavity, and the assembled cover plate prevents appreciable movement of the spacer from the cavity.

The reversing lever may include a raised portion between the first and second recesses, the raised portion including a peak and first and second ramps leading from the peak to the first and second recesses respectively. The reversing lever may include first and second stops, the first and second recesses generally disposed between the first and second stops. The ball may be partially received within the throughbore and may partially extend therefrom when the reversing lever is in the first or second lever positions. The first stop may be disposed proximate the first recess, the second stop may be disposed proximate the second recess, rotation of the reversing lever between and to the first and second lever positions forces the ball towards the bore to compress the spring therein, and rotation beyond the first and second lever positions brings the reversing lever stops into contact with the stationary structure, the stationary structure thus restricting appreciable rotation of the reversing lever beyond the first and second lever positions.

In another aspect, a reversible ratchet device such as for a reversible wrench is disclosed including a ratchet body having a cavity therein, the ratchet body having a first side with a first body opening communicating with the cavity, a ratchet assembly received by the cavity through the first body opening, the ratchet assembly including a ratchet gear having a drive portion engageable for transmitting torque from operation of the device, the ratchet assembly also including a pawl mechanism having at least one pawl selectively engageable with the ratchet gear for a selected drive direction, a cover plate attachable to the first side for closing the cavity, a spring, a ball biased by the spring, and a reversing lever operably coupled with the pawl mechanism for selecting the drive direction by rotation of the reversing lever between and to first and second lever positions, the reversing lever having a first recess for receiving the spring-biased ball in the first lever position corresponding to a first drive direction, and having a second recess for receiving the spring-biased ball in the second lever position corresponding to a second drive direction, the reversing lever further including first and second stops limiting rotation of the reversing lever appreciably beyond the first and second lever positions, the first and second recesses being formed generally between the first and second stops.

The spring and ball may be disposed within a bore, and the ball may be partially received within the bore and partially extends therefrom in contact with the reversing lever when in the first and second lever positions. The reversible ratchet device may further include a structure stationary relative to the ratchet body, the first stop being disposed proximate the first recess, the second stop being disposed proximate the second recess, and rotation of the reversing lever beyond the first and second lever positions brings the stops into contact with the stationary structure to prevent appreciable rotation of the reversing lever beyond the first and second lever positions.

In a still further aspect, a reversible ratchet device such as for a reversible wrench is disclosed including a ratchet body having a cavity therein, the ratchet body having a first side with a first body opening communicating with the cavity, a ratchet assembly received by the cavity through the first body opening, the ratchet assembly including a ratchet gear having a drive portion engageable for transmitting torque from operation of the device, the ratchet assembly also including a pawl mechanism having at least one pawl selectively engageable with the ratchet gear for a selected drive direction, a cover plate attachable to the first side for closing the cavity, a reversing lever operably coupled with the pawl mechanism for selecting the drive direction, and a spacer between the reversing lever and the cover plate, the cavity having a structure complementary to the spacer for defining the position of the spacer within the cavity.

The assembled cover plate may be proximate to the spacer to prevent appreciable movement of the spacer from the cavity. The reversing lever may include a pivot extension, and the spacer may include a pivot recess for receiving the pivot portion.

The reversible ratchet device may further include a ball and a spring, wherein the spacer includes a throughbore having a first bore opening proximate the reversing lever and a second bore opening proximate the cover plate when assembled, the throughbore receiving the ball therein through the second bore opening and receiving the spring therein through the second bore opening, the spring biasing the ball against the reversing lever proximate the first bore opening.

DETAILED DESCRIPTION

Figure 1:
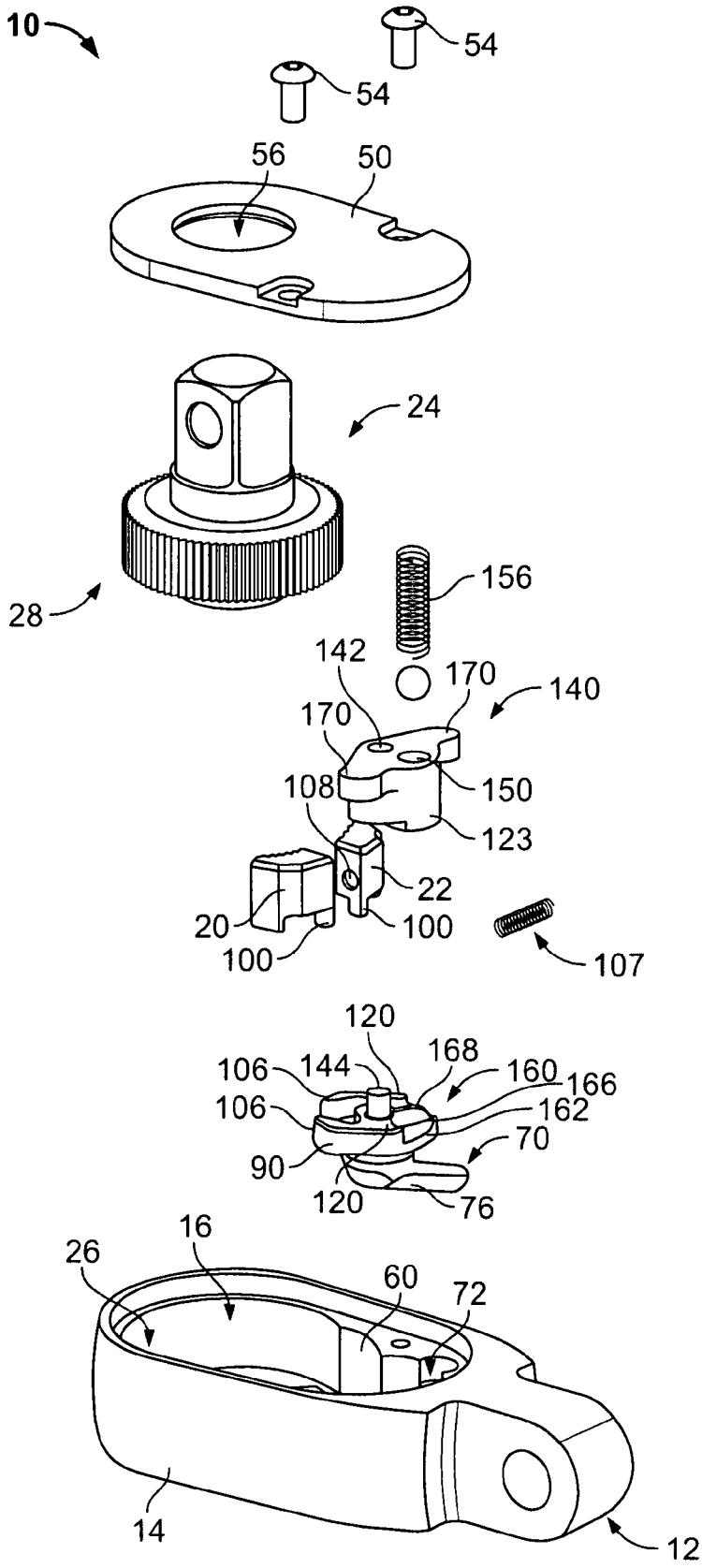
FIG. 1 is an exploded perspective view of a head of a ratchet tool in accordance with the present invention.
Figure 2:
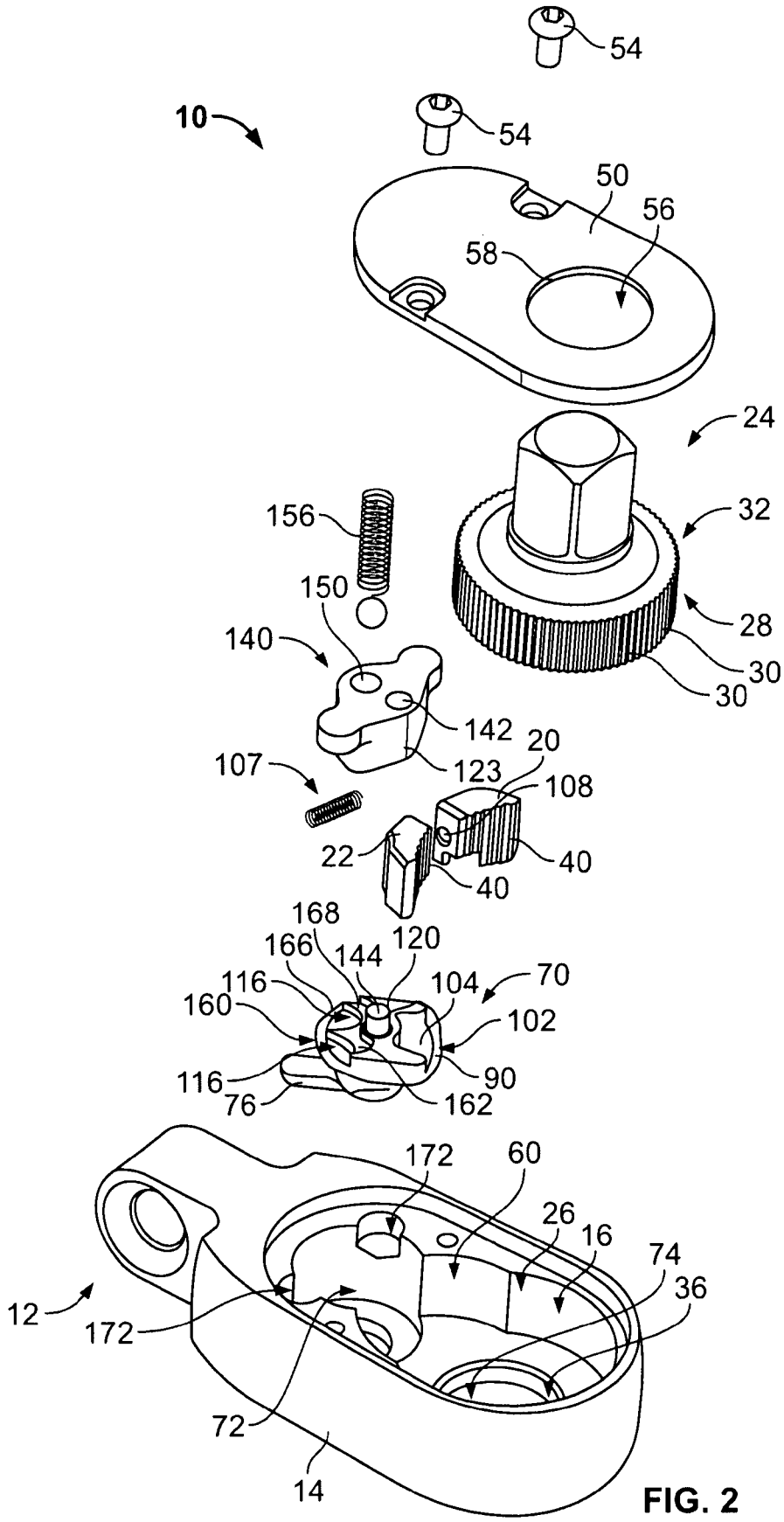
FIG. 2 is a second exploded perspective view of the ratchet tool head of FIG. 1.

Referring initially to FIGS. 1 and 2, a ratchet head 10 is depicted. While the ratchet head 10 is shown as having a connection end 12 for connecting with a yoke (not shown) on an elongated handle (not shown), it should be recognized that the ratchet head 10 may, alternatively, be integral with such a handle. The ratchet head 10 includes a body 14 including the connection end 12 and having a cavity 16 for receiving internal and external components of the ratchet head 10 for providing torque to a working piece (not shown) such as a socket or other tool or a fastener.

The ratchet head 10 is of a type of ratchet known as a dual-pawl ratchet wrench allowing a user to selectively determine a torque direction. More specifically, the ratchet head 10 includes first and second pawls 20, 22 that are selectively engaged with a ratchet gear 24, the ratchet gear 24 being operatively engageable with the working piece. When the first pawl 20 is engaged with the ratchet gear 24, torque drive is permitted with rotation of the ratchet head 10 in a first rotational drive direction while slippage occurs with rotation of the ratchet head 10 in a second rotational drive direction opposite the first. Conversely, when the second pawl 22 is engaged with the ratchet gear 24, the first pawl 20 moves out of engagement with the ratchet gear 24, and torque drive is permitted with rotation of the ratchet head 10 in the second drive direction while slippage occurs in the first drive direction.

Figure 4:
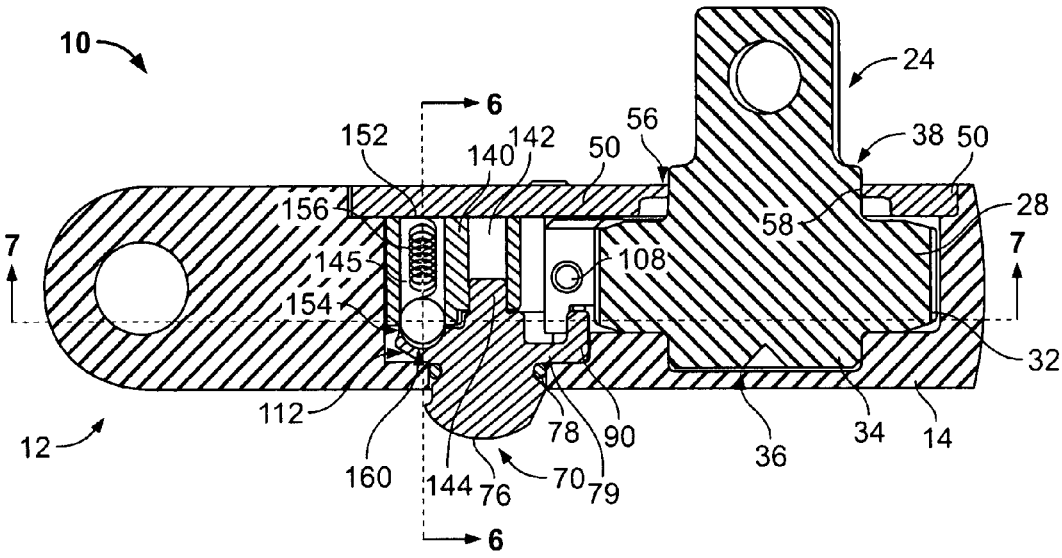
FIG. 4 is an enlarged cross-sectional view taken generally along the line 4-4 of FIG. 3.

As can be seen, the cavity 16 includes several portions for receiving and retaining the components therein. The ratchet gear 24 is received in a first large generally circular portion of the cavity 16, referred to herein as the drive cavity 26. The ratchet gear 24 has a generally circular body portion 28 with ratchet gearing or teeth 30 on a circumferential surface 32 and has an upstanding drive post 38, which may be a drive square. The ratchet teeth 30 engage with pawl teeth 40 formed on the pawls 20, 22 for selective engagement with the pawls 20, 22 to provide drive through the drive post 38. As shown in FIG. 4, the ratchet gear 24 may also have a circular lower bearing portion 34 received in a circular recess 36 below the drive cavity 26, though this may be omitted, with the bearing portion 34 assisting in centering and retaining the ratchet gear 24 within the cavity 16. Once the ratchet head 10 is assembled, a cover plate 50 is secured with the body 14 in an upper portion 52 of the cavity 16, such as by screws 54, and the cover plate 50 includes a circular bore 56 through which the drive post 38 projects for operative engagement with a working piece. The circular bore 56 also defines a bearing surface 58 (FIG. 2) for the drive post 38 to retain and position the ratchet gear 24, best seen in FIG. 4.

The pawls 20, 22 are located in a further portion of the cavity 16, referred to herein as the pawl cavity 60, and the drive cavity 26 and pawl cavity 60 are overlapping or communicating to permit the pawls 20, 22 to move into and out of engagement with the ratchet teeth 30 of the ratchet gear 24.

Figure 3:
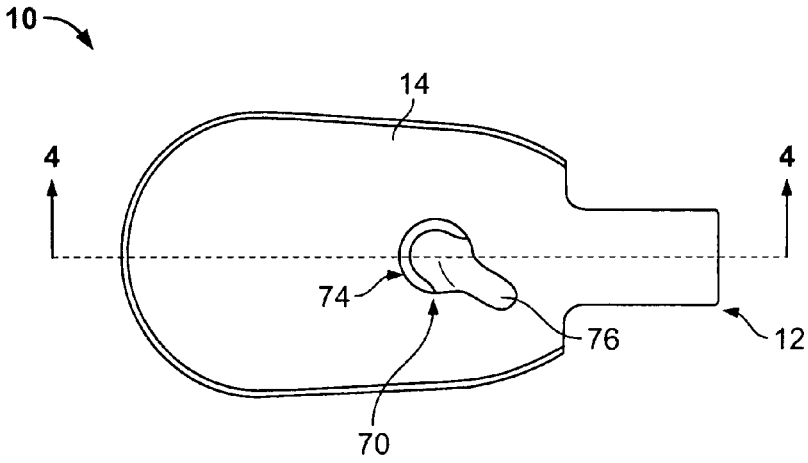
FIG. 3 is a bottom plan view of an assembled ratchet tool head of FIG. 1.
Figure 6:
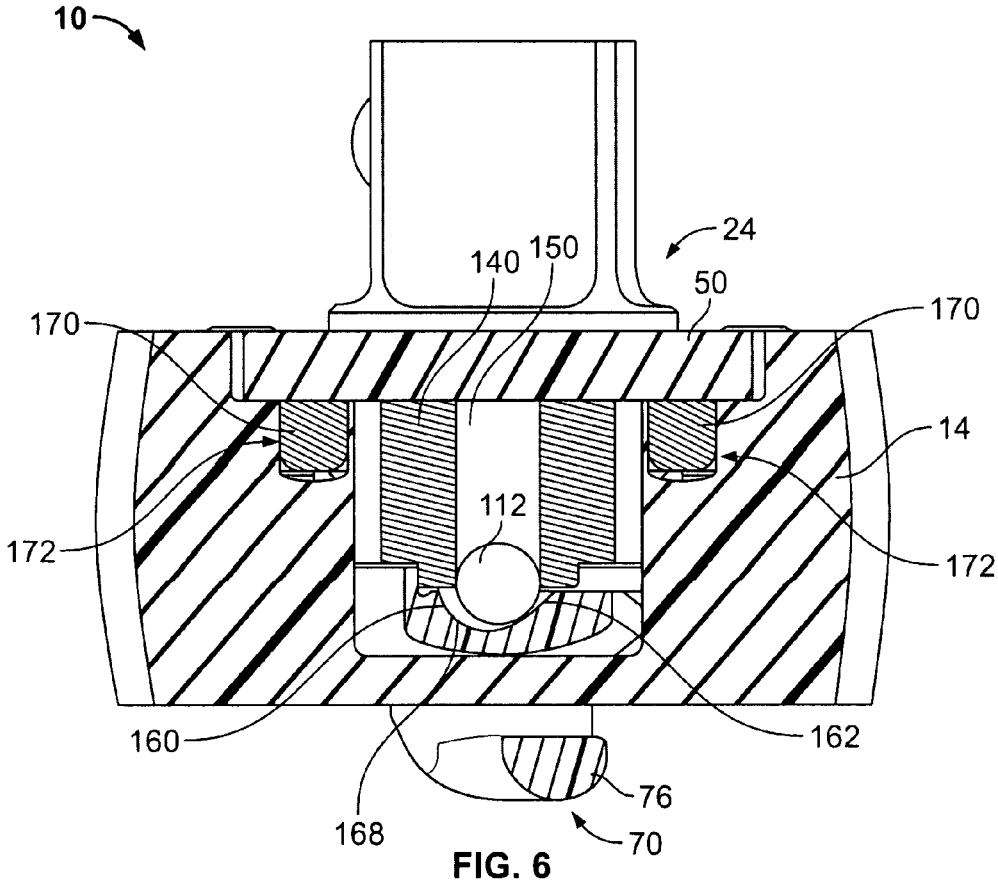
FIG. 6 is a cross-sectional view taken generally along the line 6-6 of FIG. 4.

As will be discussed in greater detail below, an actuator for selectively engaging and disengaging the pawls 20, 22 with the ratchet gear 24 is provided, referred to herein as a reversing lever 70. The reversing lever 70 is received in a further circular cavity portion of the cavity 16, referred to herein as the actuator cavity 72 (FIGS. 1 and 2). A throughbore 74 (FIG. 2) is provided on the bottom of the body 14 so that the reversing lever 70 may extend from the actuator cavity 72 through the throughbore 74 so that an actuator portion in the form of a lever portion 76 of the reversing lever 70 is positioned on the outside of the ratchet head 10 and is manually operated to select a drive direction by a user, as best viewed in FIG. 3. As can be seen in FIG. 4, a seal 78 is positioned around the portion of the reversing lever 70 disposed in the throughbore 74 to impede or prevent contaminants from entering the working portions of the ratchet head 10. The reversing lever 70 is assembled with the body 14 by inserting the lever portion 76 of the reversing lever 70 into the actuator cavity 72 from a first side of the ratchet body 14 (the upper side as viewed in FIGS. 1 and 2), and by extending the lever portion 76 through the throughbore 74 to a second side of the ratchet body 14, which promotes the ability to utilize the seal 78 for preventing ingress of contaminants. The lever 70 has a portion 79 which is sized to prevent passage through the throughbore 74, so that the lever 70 can be mounted in only one direction. The seal 78 is somewhat compressed and/or held in position between the body 14 and the reversing lever 70 by the position of the reversing lever 70, which is itself held in position by a spacer 140, discussed below, which is held in place by the cover plate 50, as can be seen in FIGS. 4 and 6.

Figure 7:
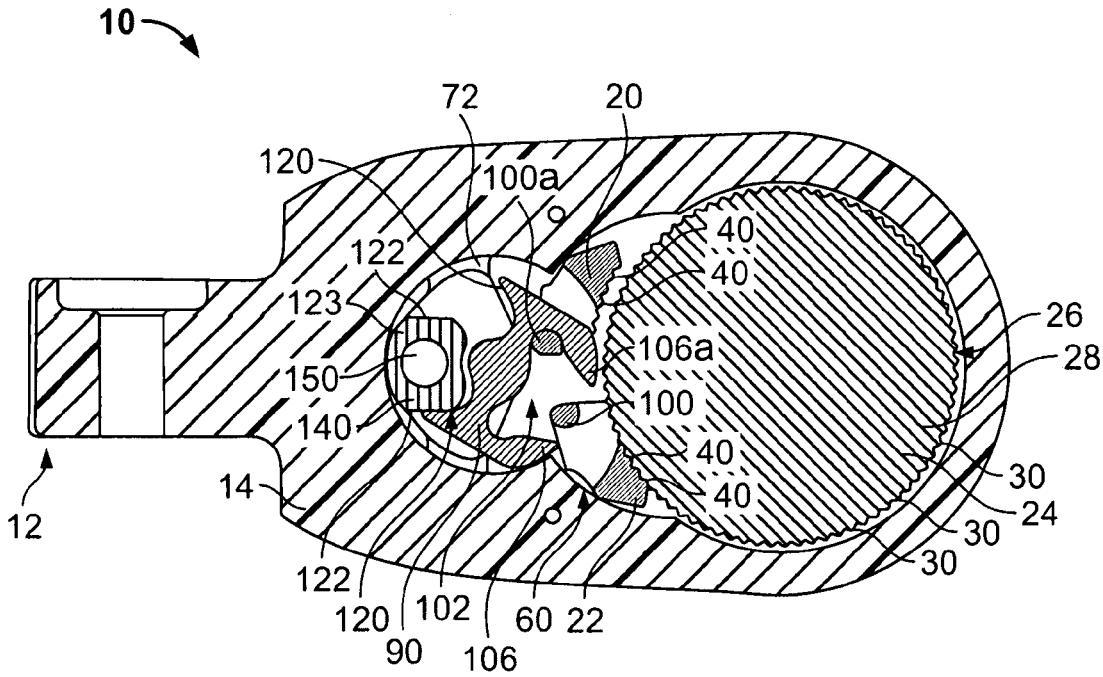
FIG. 7 is a cross-sectional view taken generally along the line 7-7 of FIG. 4.

As described, the reversing lever 70 is selectively positioned to select one of the pawls 20, 22 for selecting a drive direction. In order to effect this selection, the reversing lever 70 includes a reversing disc portion 90, below which the seal 78 is compressed. Each of the pawls 20, 22 has a selector post 100 for being manipulated by the reversing disc portion 90. More specifically, the reversing disc portion 90 has a recess 102 defined by a surface 104 and by hooks 106. With reference to FIG. 7, as the disc portion 90 is shifted to one position for a selected drive direction, a first hook **106*a* catches a selector post 100*a* of, for example, the first pawl 20, and continued rotation of the reversing disc 90 draws the first pawl 20 away from and out of engagement with the drive portion ratchet teeth 30, the selector post 100*a* being pulled into the recess 102 as shown in FIG. 7. Simultaneously, a second hook 106*b* that was engaged with a selector post 100*b* of the second pawl 22 allows the selector post 100*b* to move from the recess 102 so that the second pawl 22 shifts to becomes engaged with the drive portion ratchet teeth 30, as shown in FIG. 7. A bias member such as a coil spring 107 (FIGS. 1 and 2) is positioned between the pawls 20, 22, the ends of the spring 107 being received and retained by a bore 108 formed in a side of each pawl 20, 22, the respective bores 108 of the two pawls 20, 22 being in an opposed orientation so that the spring 107 biases the pawls 20, 22 away from each other (see FIGS. 1 and 2). In this manner, when the disc portion 90 causes catches a selector post 100 of one of the pawls 20, 22 to move the pawl, the spring 107 causes the other pawl to shift position. Additionally, the spring 107 allows the pawl to cam or deflect away from the ratchet gear teeth 30 when a first drive direction is selected but the ratchet head 10 is rotated in reverse, in an opposite direction, to allow slippage in that direction, the spring 107 then forcing the pawl to return to engagement with the teeth 30** when such reverse movement ceases.

As noted above, a spacer 140 is provided to position the reversing lever 70. In greater detail, the reversing lever 70 is positioned between the ratchet body 14 and the spacer 140, and the spacer 140 abuts a bottom side of the cover plate 50. The spacer 140 includes a recess 142 into which a portion of the reversing lever 70 is received. This portion is an upstanding post 144, forming a pivot, with a generally circular geometry (FIGS. 1, 2 and 4), and the recess 142 is generally circular so as to form a pivot or bearing surface with the reversing lever post 144.

The ratchet head 10 is preferably designed to promote a tactile feel for a user to identify when the reversing lever 70 is in a proper position for the two drive directions. Towards this end, a ball and detent structure are provided, as is common in devices of this type. More specifically, the spacer 140 has a throughbore 150 (FIG. 4) into which a ball 112 in inserted from an upper opening 152 of the throughbore 150 so that the ball 112 is positioned proximate a lower opening 154 in the throughbore 150. A spring 156 (FIG. 4) is then inserted into the throughbore 150 via the upper opening 152. The spring 156 contacts and is retained in the throughbore 150 by the cover plate 50. In this manner, assembling the ball 112 and spring 156 is simplified, and manufacturing of the ratchet head 10 is simplified by not having to balance or otherwise hold the ball 112 on the spring 156 during assembly, as is the case for prior art devices.

Figure 5:
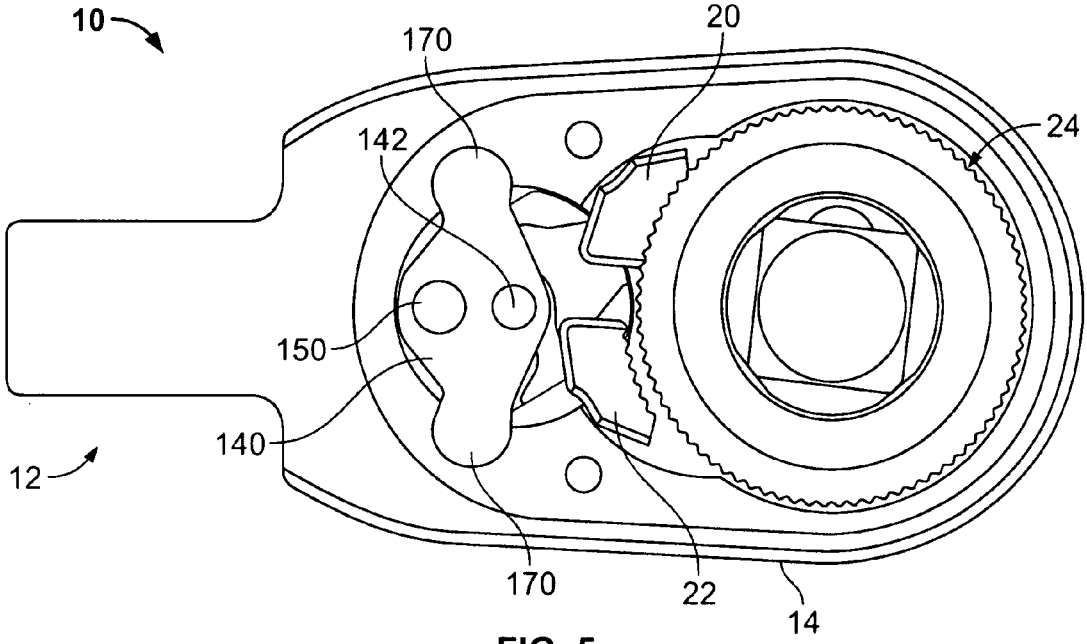
FIG. 5 is an enlarged top plan of the assembled ratchet head of FIG. 3 with a cover removed.

As best seen in FIGS. 4, 5, and 7, the spacer throughbore 150 is positioned outboard from the center of rotation of the reversing lever 70. Therefore, as the reversing lever 70 is rotated, the ball 112 contacts and moves along a surface 160 of the reversing lever 70. More specifically, the surface 160 of the reversing lever 70 is formed on the disc portion 90 and includes a pair of detents or troughs 116 positioned thereon to correspond to proper positions for the ball 112 when the reversing lever 70 is in the proper position for the first and second drive directions. The surface 160 includes first and second ramps 162 that meet generally between the troughs 116, at a peak 166 though the peak 166 is positioned along an arc in consideration of the rotation of the reversing lever 70 relative to the ball 112 positioned in the spacer throughbore 150. Preferably, the ramps 162 are linear or flat (rise and run are in direct relation).

With the reversing lever 70 in an initial position with the ball 112 positioned in a first of the troughs 116, the reversing lever 70 may be rotated thereby forcing the ball 112 to ride up one of the ramps 162 and forcing the spring 156 to compress. Once the ball 112 passes over the meeting point or peak 166 where the ramps 162 meet, the spring 156 provides a bias to advance the reversing lever 70 towards a second of the troughs 116. When the ball 112 is aligned with one of the troughs 116, the ball 112 at least partially extends from the spacer throughbore 150. Each of the troughs 116 is partially defined or shaped with a wall portion 168 extending upwardly with which the ball 112 comes into contact when the reversing lever 70 has reached the proper position.

The spacer 140 is easily mounted in the ratchet body 14. The spacer 140 includes at least one and preferably two portions 170 having complementary shapes to portions of the ratchet body 14 so that the spacer 140 may be assembled easily, such as in a linear fashion, into a defined position. In the present form, the spacer portions 170 are in the form of partially circular wings or ears that are received in ear recesses 172 formed to the sides of the actuator cavity 72. In this manner, the spacer 140 may be properly positioned easily, and the cover plate 50 abutting a top surface of the spacer 140 prevents the spacer 140 from moving from the assembled positioned, without the need for screws or other securements.

In order to promote the tactile feel for the user, as well as to promote rotation of a proper amount, a stop mechanism is provided. In the present form, this stop mechanism is provided by structure formed on the reversing disc portion 90 and the spacer 140. However, it should be noted that the structure may be provided on any portion of the components used for reversing the direction and on any portion of the components that remain relatively stationary when the reversing lever 70 is being moved. Here, the reversing disc portion 90 includes a first and second stops surfaces 120 formed proximate the troughs 116, as best seen in FIG. 2. As can be seen in FIG. 7, rotation of the reversing lever 70 causes the stop surfaces 120 to move into contact with stops 122 formed on a portion 123 of the spacer 140. In this manner, over-rotation of the reversing lever 70 is prevented, and the user is provided with a positive tactile feel of full rotation.

It should also be noted that the ratchet head 10, as described, simplifies manufacturing costs and labor. The reversing lever 70 is inserted into the cavity 16 so that the lever portion 76 extends from the throughbore 74, and is sealed therewith by the seal 78. The ratchet gear 24 is inserted into the cavity 16 with the bearing portion 34 received in the recess 36. The pawls 20, 22 and the spring 107 therebetween are positioned within the cavity 16 between the reversing lever post 144 and the ratchet gear 24, and above the reversing disc portion 90, one of the pawl selector posts 100 being received by one of the hooks 106. The spacer 140 is inserted with the spacer depending portion 123 between the reversing lever stop surfaces 120, the ears 170 being received in the ear recesses 172. The ball 112 is inserted into the throughbore 150, and then the spring 156 associated with the ball 112. The cover plate 50 is then installed such as with the two screws 54. The spacer 150 is restricted from shifting upward by the cover plate 50, and from shifting downward by its cooperation with the reversing lever post 144. Generally, the design of the ratchet head 10 serves to retain and position each component with the ratchet body 14, with the cover plate 50, or through cooperation with one of the other components, thus minimizing the use of screws or other securements, for instance, and other manufacturing steps common to assembling dual ratchet wrenches.

While the invention has been described with respect to specific examples including presently preferred modes of carrying out the invention, those skilled in the art will appreciate that there are numerous variations and permutations of the above described systems and techniques that fall within the spirit and scope of the invention as set forth in the appended claims.

What is claimed is:

1. A reversible ratchet device comprising:

a ratchet body having a cavity therein, the ratchet body having a first side with a first body opening communicating with the cavity;

a reversing lever rotatably disposed within the cavity of the ratchet body;

a pawl mechanism having at least one pawl selectively coupled with the reversing lever within the ratchet body;

a ratchet gear having a drive portion and a toothed portion, the toothed portion rotatably disposed within the cavity of the ratchet body and engageable with the at least one pawl, the drive portion projecting out of the cavity of the ratchet body and engageable for transmitting torque from operation of the device;

a cover plate attachable to the first side of the ratchet body for closing the cavity, the cover plate having an aperture configured to receive the drive portion of the ratchet gear projecting out of the cavity;

a spacer disposed within the cavity of the ratchet body between the reversing lever and the cover plate;

a bore formed in the spacer;

a spring disposed in the bore;

a ball disposed in the bore, the ball being biased by the spring toward the reversing lever; and the reversing lever being operably coupled with the pawl mechanism for selecting the drive direction, the reversing lever being rotatable with respect to the bore and having an axis of rotation generally parallel to the bore, the reversing lever having an axially-oriented surface with a first recess for receiving the spring-biased ball in a first lever position corresponding to a first drive direction and with a second recess for receiving the spring-biased ball in a second lever position corresponding to a second drive direction, and the reversing lever having a raised portion between the first and second recesses, the raised portion including a peak and first and second ramps leading from the peak to the first and second recesses respectively.

2. The reversible ratchet device of claim 1 wherein the first and second ramps each have a slope, and each slope is generally linear.

3. The reversible ratchet device of claim 1 wherein the spacer is stationary relative to the ratchet body, the ball being partially received within the bore and partially extending from the bore when the reversing lever is in the first or second lever positions.

4. The reversible ratchet device of claim 3 wherein the reversing lever further includes first and second stops formed thereon, the first and second recesses disposed between the first and second stops.

5. The reversible ratchet device of claim 4 wherein the first stop is disposed proximate the first recess, the second stop is disposed proximate the second recess, rotation of the reversing lever between and to the first and second lever positions forces the ball towards the bore to compress the spring therein, and rotation beyond the first and second lever positions brings the reversing lever stops into contact with the spacer, the spacer thus restricting appreciable rotation of the reversing lever beyond the first and second lever positions.

6. The reversible ratchet device of claim 1 wherein the spacer is received by the cavity through the first body opening, the cavity and spacer have complementary structure for defining the position of the spacer within the cavity, and the assembled cover plate prevents appreciable movement of the spacer from the cavity.

7. The reversible ratchet device of claim 1 wherein the bore is a throughbore having a first bore opening assembled proximate the reversing lever and a second bore opening assembled proximate the cover plate, the ball being inserted into the throughbore through the second bore opening to be proximate the reversing lever at the first bore opening, and the spring being inserted into the throughbore through the second bore opening to be proximate the cover plate at the second bore opening.

8. A reversible ratchet device comprising:

a ratchet body having a cavity therein, the ratchet body having a first side with a first body opening communicating with the cavity;

a ratchet gear having a drive portion and a toothed portion, the toothed portion rotatably disposed within the cavity of the ratchet body, the drive portion projecting out of the cavity of the ratchet body and engageable for transmitting torque from operation of the device;

a pawl mechanism within the cavity of the ratchet body, the pawl mechanism having at least one pawl selectively engageable with the toothed portion of the ratchet gear for a selected drive direction;

a cover plate attachable to the first side of the ratchet body for closing the cavity, the cover plate having an aperture configured to receive the drive portion of the ratchet gear projecting out of the cavity;

a reversing lever rotatably disposed within the cavity of the ratchet body, the reversing lever being operably coupled with the at least one pawl of the pawl mechanism for selecting the drive direction, the reversing lever having first and second recesses and being movable between and to first and second lever positions corresponding to respective first and second drive directions;

a spacer disposed within the cavity of the ratchet body between the reversing lever and the cover plate;

a throughbore formed in the spacer, the throughbore having a first bore opening proximate to the reversing lever and a second bore opening distal to the reversing lever, the reversing lever being rotatable with respect to the throughbore and having an axis of rotation generally parallel to the throughbore;

a spring disposed in the throughbore; and a ball disposed in the throughbore, the ball being biased by the spring into the reversing lever first recess in the first drive direction and biased by the spring into the reversing lever second recess in the second drive direction, the ball being inserted through the second bore opening to be disposed in biased contact with the reversing lever at the first bore opening, and the spring being inserted into the second bore opening after the ball is inserted therein.

9. The reversible ratchet device of claim 8 wherein the cover plate is assembled proximate the second bore opening, and the spring is compressibly disposed between the cover plate at the second bore opening and the ball.

10. The reversible ratchet device of claim 8 wherein the spacer and the cavity have complementary structure for defining the position of the spacer within the cavity, and the assembled cover plate prevents appreciable movement of the spacer from the cavity.

11. The reversible ratchet device of claim 8 wherein the reversing lever includes a raised portion between the first and second recesses, the raised portion including a peak and first and second ramps leading from the peak to the first and second recesses respectively.

12. The reversible ratchet device of claim 8 wherein the reversing lever includes first and second stops, the first and second recesses generally disposed between the first and second stops.

13. The reversible ratchet device of claim 12 wherein the ball is partially received within the throughbore and partially extends therefrom when the reversing lever is in the first or second lever positions.

14. The reversible ratchet device of claim 13 wherein the spacer is stationary relative to the ratchet body, wherein the first stop is disposed proximate the first recess, the second stop is disposed proximate the second recess, rotation of the reversing lever between and to the first and second lever positions forces the ball towards the throughbore to compress the spring therein, and rotation beyond the first and second lever positions brings the reversing lever stops into contact with the spacer, the spacer thus restricting appreciable rotation of the reversing lever beyond the first and second lever positions.

15. A reversible ratchet device comprising:

a ratchet body having a cavity therein, the ratchet body having a first side with a first body opening communicating with the cavity;

a reversing lever rotatable disposed within the cavity of the ratchet body;

a pawl mechanism having at least one pawl selectively coupled with the reversing lever within the ratchet body;

a ratchet gear having a drive portion and a toothed portion, the toothed portion rotatably disposed within the cavity of the ratchet body and engageable with the at least one pawl, the drive portion projecting out of the cavity of the ratchet body and engageable for transmitting torque from operation of the device;

a cover plate attachable to the first side of the ratchet body for closing the cavity, the cover plate having an aperture configured to receive the drive portion of the ratchet gear projecting out of the cavity;

a spacer disposed within the cavity of the ratchet body between the reversing lever and the cover plate;

a bore formed in the spacer;

a spring disposed in the bore; and a ball disposed in the bore, the ball being biased by the spring toward the reversing lever;

the reversing lever being operably coupled with the pawl mechanism for selecting the drive direction by rotation of the reversing lever between and to first and second lever positions, the reversing lever being rotatable with respect to the bore and having an axis of rotation generally parallel to the bore, the reversing lever having an axially oriented surface with respect to the axis of rotation of the reversing lever, the reversing lever having a first recess for receiving the spring-biased ball in the first lever position corresponding to a first drive direction, and having a second recess for receiving the spring-biased ball in the second lever position corresponding to a second drive direction, the reversing lever further including first and second stops limiting rotation of the reversing lever appreciably beyond the first and second lever positions, the first and second recesses being formed generally between the first and second stops.

16. The reversible ratchet device of claim 15 wherein the spring and ball are disposed within the bore, and the ball is partially received within the bore and partially extends therefrom in contact with the reversing lever when in the first and second lever positions.

17. The reversible ratchet device of claim 16 wherein the spacer is stationary relative to the ratchet body, wherein the first stop is disposed proximate the first recess, the second stop is disposed proximate the second recess, and rotation of the reversing lever beyond the first and second lever positions brings the stops into contact with the spacer to prevent appreciable rotation of the reversing lever beyond the first and second lever positions.

18. A reversible ratchet device comprising:

a ratchet body having a cavity therein, the ratchet body having a first side with a first body opening communicating with the cavity;

a ratchet gear having a drive portion and a toothed portion, the toothed portion rotatably disposed within the cavity of the ratchet body, the drive portion projecting out of the cavity of the ratchet body and engageable for transmitting torque from operation of the device;

a pawl mechanism disposed within the cavity of the ratchet body, the pawl mechanism having at least one pawl selectively engageable with the toothed portion of the ratchet gear for a selected drive direction;

a cover plate attachable to the first side of the ratchet body for closing the cavity, the cover plate having an aperture configured to receive the drive portion of the ratchet gear projecting out of the cavity;

a reversing lever rotatably disposed within the cavity of the ratchet body, the reversing lever being operably coupled with the at least one pawl of the pawl mechanism for selecting the drive direction; and a spacer disposed within the cavity of the ratchet body between the reversing lever and the cover plate, the cavity having a structure complementary to the spacer for defining the preventing movement of the spacer within the cavity, the reversing lever being rotatable with respect to the spacer.

19. The reversible ratchet device of claim 18 wherein the assembled cover plate is proximate to the spacer to prevent appreciable movement of the spacer from the cavity.

20. The reversible ratchet device of claim 19 wherein the reversing lever includes a pivot extension, and the spacer includes a pivot recess for receiving the pivot extension.

21. The reversible ratchet device of claim 18 further including a ball and a spring, wherein the spacer includes a throughbore having a first bore opening proximate the reversing lever and a second bore opening proximate the cover plate when assembled, the throughbore receiving the ball therein through the second bore opening and receiving the spring therein through the second bore opening, the spring biasing the ball against the reversing lever proximate the first bore opening.

* * * * *